US007665187B1

(12) United States Patent
Elowsky

(10) Patent No.: US 7,665,187 B1
(45) Date of Patent: Feb. 23, 2010

(54) HINGE APPARATUS AND METHOD

(76) Inventor: James E. Elowsky, 4329 Cloverwood Ct., Gulf Breeze, FL (US) 32563

( * ) Notice: Subject to any disclaimer, the term of this patent is extended or adjusted under 35 U.S.C. 154(b) by 527 days.

(21) Appl. No.: 11/485,794

(22) Filed: Jul. 13, 2006

(51) Int. Cl.
*E05D 1/00* (2006.01)

(52) U.S. Cl. ..... 16/390; 16/252; 16/392

(58) Field of Classification Search ..... 16/387, 16/389–392, 252; D8/323, 328, 329
See application file for complete search history.

(56) References Cited

U.S. PATENT DOCUMENTS

| | | | | | |
|---|---|---|---|---|---|
| 269,126 | A * | 12/1882 | Shupe | 16/390 |
| 1,382,083 | A * | 6/1921 | Heyman | 16/390 |
| 1,590,177 | A * | 6/1926 | Andreotti | 16/392 |
| 1,640,525 | A * | 8/1927 | Belliveau | 16/390 |
| 2,011,528 | A * | 8/1935 | Seay | 256/26 |
| 2,268,669 | A * | 1/1942 | Moore | 160/229.1 |
| 2,853,747 | A * | 9/1958 | Anderson | 49/399 |
| 3,131,422 | A * | 5/1964 | Agius | 16/392 |
| 3,153,807 | A * | 10/1964 | Nyman | 16/390 |
| 4,141,110 | A * | 2/1979 | Wanek | 16/252 |
| 4,161,850 | A * | 7/1979 | Peterson et al. | 52/65 |
| 5,199,218 | A * | 4/1993 | McQuade | 49/381 |
| D372,852 | S * | 8/1996 | Noll et al. | D8/328 |

* cited by examiner

*Primary Examiner*—Chuck Y. Mah
(74) *Attorney, Agent, or Firm*—J. Nevin Shaffer, Jr.

(57) ABSTRACT

A hinge apparatus includes a first hinge section with a pair of oppositely positioned flange sections connected to the first hinge section. A second hinge section is provided with a pair of oppositely positioned flange sections connected to the second hinge section and a hinge device moveably connects the first hinge section and the second hinge section.

4 Claims, 2 Drawing Sheets

HINGE APPARATUS AND METHOD

FIELD OF THE INVENTION

This invention relates to a hinge apparatus and method. In particular, in accordance with one embodiment, the invention relates to a hinge apparatus including a first hinge section with a pair of oppositely positioned flange sections connected to the first hinge section. A second hinge section is provided with a pair of oppositely positioned flange sections connected to the second hinge section and a hinge device moveably connects the first hinge section and the second hinge section.

BACKGROUND OF THE INVENTION

A hinge is a useful tool for moveably connecting objects. In wooden fence construction, for example only and not by limitation, the most popular prior art method of creating a hinged walk gate is to install "strap hinges". Strap hinges are hinges that are flush mounted to the face of the gate section with lag screws. The lag screws horizontally penetrate the fence board and the two by four, for example, stringer so as to secure the strap hinge to the gate section. Thus the entire weight of the gate section hangs on the horizontal screws which inevitably sag and tilt downward under the force of gravity. This causes the gate section to become misaligned such that the gate drags on the ground, making the gate difficult to open and close and sometimes making the gate section inoperable.

Another problem with the prior art gate hinge is that it only operates in one direction. The prior art strap hinges only allow a gate to swing out. Further, strap hinges are weak, as described above and are, therefore, very ineffective in securely holding heavier gates, such as drive gates, in position.

Thus, there is a need in the art for providing a hinge that maintains the gate in the selected operable position without sagging. It, therefore, is an object of this invention to provide a hinge apparatus and method that is easy to use, easy to install and which, when installed, holds objects to which it is attached against misalignment. It is a further object of the invention to provide a universal hinge that operates effectively as a hinge in two directions without need of modification.

SUMMARY OF THE INVENTION

Accordingly, the hinge apparatus and method of the present invention includes, according to one embodiment a first hinge section with a pair of oppositely positioned flange sections connected to the first hinge section. A second hinge section is provided with a pair of oppositely positioned flange sections connected to the second hinge section and a hinge device moveably connects the first hinge section and the second hinge section.

According to another aspect of this invention, the hinge includes an offset in the first hinge section and the second hinge section. In another aspect, a connecting face section connects the oppositely positioned flange sections. In a further aspect, the oppositely positioned flange sections are connected transverse to the first hinge section and the second hinge section. In another aspect, the oppositely positioned flange sections are connected at approximately right angles to the first hinge section and the second hinge section. According to another aspect of this invention, the oppositely positioned flange sections include holes. In a further aspect, the offset is approximately ¼ inch. In another aspect, the offset is between approximately ¼ inch to ⅝ inch.

According to another embodiment of the invention, a hinge apparatus includes a first hinge connection section and a second hinge connection section. A first upper flange section is connected transverse to the first hinge connection section and a second upper flange section is connected transverse to the second hinge connection. A first lower flange section is connected transverse to the first hinge connection and is spaced apart from the first upper flange section and a second lower flange section is connected transverse to the second hinge connection and is spaced apart from the second upper flange section. A hinge movably connects the first hinge connection section and the second hinge connection section.

In accordance with another aspect of this invention, an offset is provided in the first hinge connection section and the second hinge connection section. In another aspect, the flange sections are connected at approximately right angles to the first hinge connection section and the second hinge connection section. In another aspect, the flange sections are conformed to attach vertically to an object. In another aspect, the flange sections include attachment holes. According to one aspect, the hinge is a hinge pin. In another aspect, the offset is between approximately ¼ inch to approximately ⅝ inch.

According to another embodiment of the invention, a method of creating a hinged gate includes: providing a hinge with a first hinge section with a first pair of oppositely positioned flange sections connected to the first hinge section and with a second hinge section with a second pair of oppositely positioned flange sections connected to the second hinge section and with a hinge device moveably connecting the first hinge section and the second hinge section; enveloping a stationary section of a gate with the first pair of oppositely positioned flange sections and vertically attaching the first pair of oppositely positioned flange sections to the stationary section of the gate; and enveloping a moveable section of the gate with the second pair of oppositely positioned flange sections and vertically attaching the second pair of oppositely positioned flange sections to the moveable section of the gate.

In another aspect of this invention, the first hinge section and the second hinge section include an offset. In a further aspect, the flange sections are connected at approximately right angles to the first hinge section and the second hinge section. In another aspect, the oppositely positioned flange sections include attachment holes. And, in another aspect, the user rotates the moveably connected first hinge section and second hinge section 180-degrees such that the hinged gate will open in the opposite direction.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
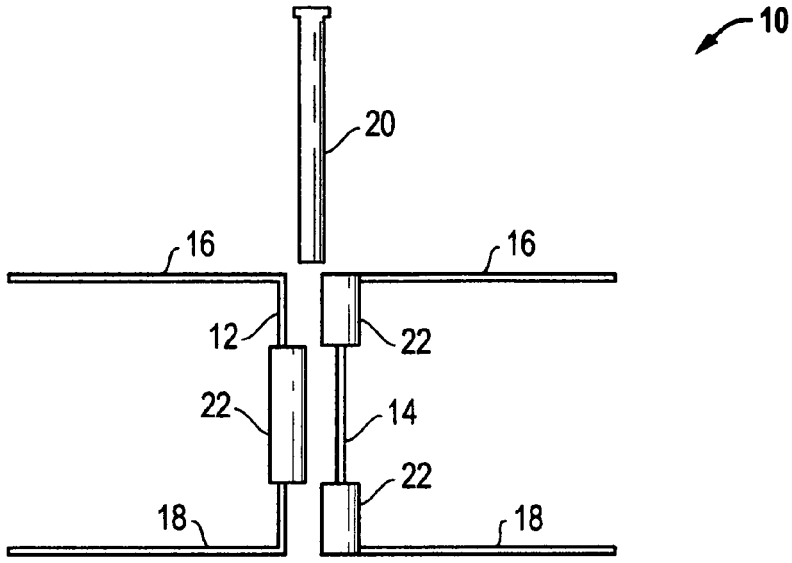
FIG. 1 is an exploded view of the hinge apparatus according to one embodiment of the invention.

The preferred embodiment of the present invention is illustrated by way of example in FIGS. 1-4. With specific reference to FIG. 1, the hinge apparatus 10, according to one embodiment of the present invention, includes a first hinge section 12 and a second hinge section 14. An upper flange section 16 and a lower flange section 18 are connected to the first hinge section 12 and the second hinge section 14 such that the upper flange section 16 is maintained in a spaced apart relation to the lower flange section 18. As illustrated, upper flange section 16 and lower flange section 18 are connected transverse to first hinge section 12 and second hinge section 14. According to one embodiment, upper flange section 16 and lower flange section 18 are connected approximately at right angles to first hinge section 12 and second hinge section 14. First hinge section 12 and second hinge section 14 may be any dimension desired including a narrow band of uniform dimension as shown in FIG. 1 or, preferably, it includes a connecting face section 13 as wide as the upper and lower flange sections 16 and 18 as more clearly shown in FIG. 3.

FIG. 1 shows hinge pin 20 and hinge pin receivers 22. Hinge pin receivers 22 are connected to first and second hinge sections 12 and 14 such that they interlock when aligned and form a connection receiver tube into which hinge pin 20 is inserted so as to moveably join first hinge section 12 and second hinge section 14, as is known in the art and not disclosed further hereafter. According to a preferred embodiment, hinge pin 20 is "fast set" and/or spun on both ends so that pin 20 once in place will not fall out and can not be tapped out as is known with common door hinge pins. Thus, when Applicant's hinge apparatus 10 is reversed to allow a gate to open in the opposite direction, as will be discussed more fully hereafter, the hinge pin 20 can not and will not be at risk of falling out.

Figure 2:
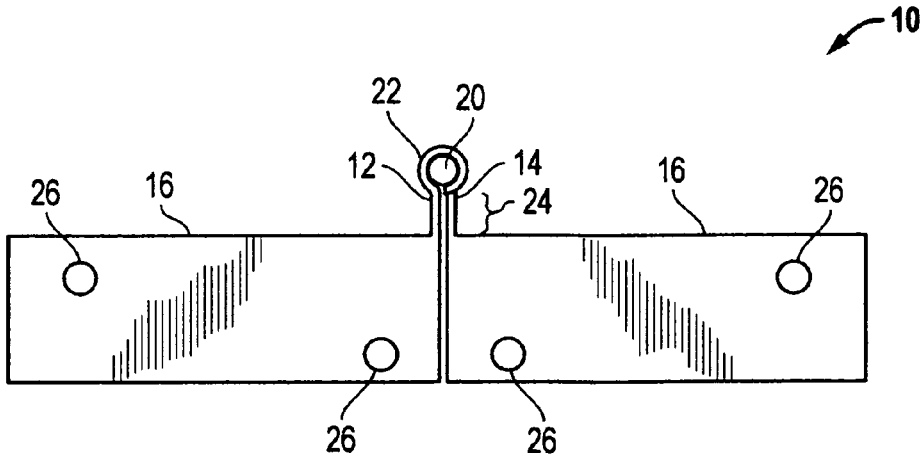
FIG. 2 is a top view of the hinge apparatus according to one embodiment shown in the closed position.

Referring now to FIG. 2, a top view of the hinge apparatus 10 of the present invention is shown "assembled" in that hinge pin 20 is in place in hinge pin receivers 22, that were aligned before hand as discussed above. Hinge apparatus 10 is shown in the "closed position" as will be discussed more fully hereafter. FIG. 2 illustrates an important feature according to one aspect of the invention where first and second hinge sections 12 and 14 include offset 24. Prior art door hinges, for example, are located directly next to the hinge sections with no appreciable offset. Applicant's offset 24 is an extended portion of first and second hinge sections 12 and 14 that results in hinge pin 20 being located a distance away from upper and lower flange sections 16 and 18. Offset 24 is preferably approximately ⅝ of an inch and up to 1⅛ inches with the useful formula being that the offset 24 is at least ⅛ of an inch bigger than the thickness of the board to be attached to the stringer to which the hinge apparatus 10 is attached. Thus if the board is 1 inch the offset should be 1⅛ inch. The function of the offset 24 is to enable the board to rotate around the hinge pin 20 and not bind to adjacent boards. Obviously, offset 24 may be any desired length useful for the purposes of the invention. In general, however, offset 24 is most useful when hinge apparatus 10 is used with a moveable gate section to allow the moveable gate section to fully open as will be discussed more fully hereafter.

FIG. 2 also illustrates another feature of the invention where upper flange sections 16 and lower flange sections 18 include holes 26. Holes 26 are useful in providing pre-formed locations for screws, nails or the like to be inserted when hinge apparatus 10 is attached to an object. Any useful number of attachment holes 26 may be provided.

Figure 3:
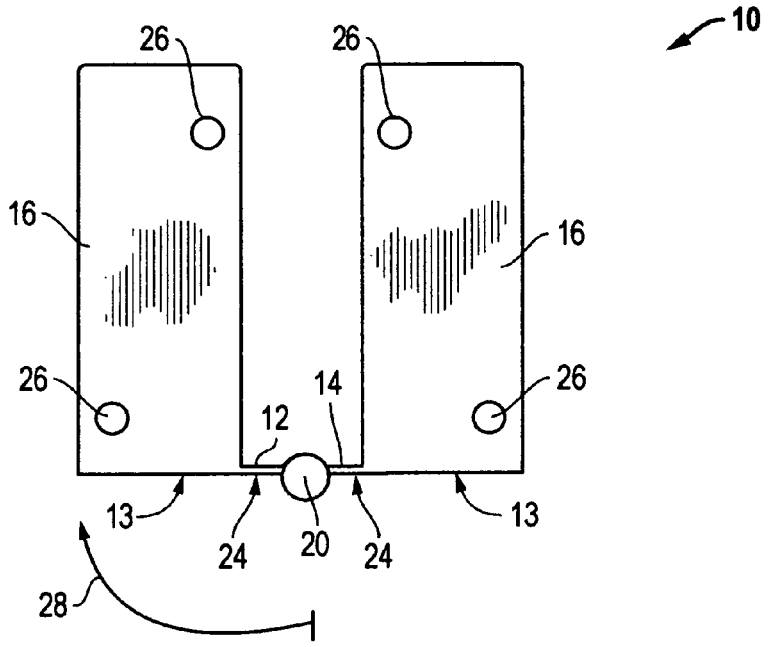
FIG. 3 is a top view of the hinge of FIG. 2 shown in the open position.

Referring now to FIG. 3, hinge apparatus 10 is shown in a top view, as in FIG. 2, but in the "open position". For purposes of explanation, second hinge section 14 is in the same position in the "open position" as in the "closed position" shown in FIG. 2. Thus, for example, second hinge section 14 may be imagined to be attached to a non-moving part of a gate system, the fence, for example. On the other hand, first hinge section 12 as shown in FIG. 3, has moved in the direction of arrow 28 from the "closed position" shown in FIG. 2 to the "open position". First hinge section 12 may be imagined, therefore, for example, to be attached to the moveable portion of a gate system, the gate, for example. Once hinge apparatus 10 is vertically attached, as will be more fully described hereafter, hinge apparatus 10 easily moves to the open position and back to the closed position by moving around hinge pin 20.

Figure 4:
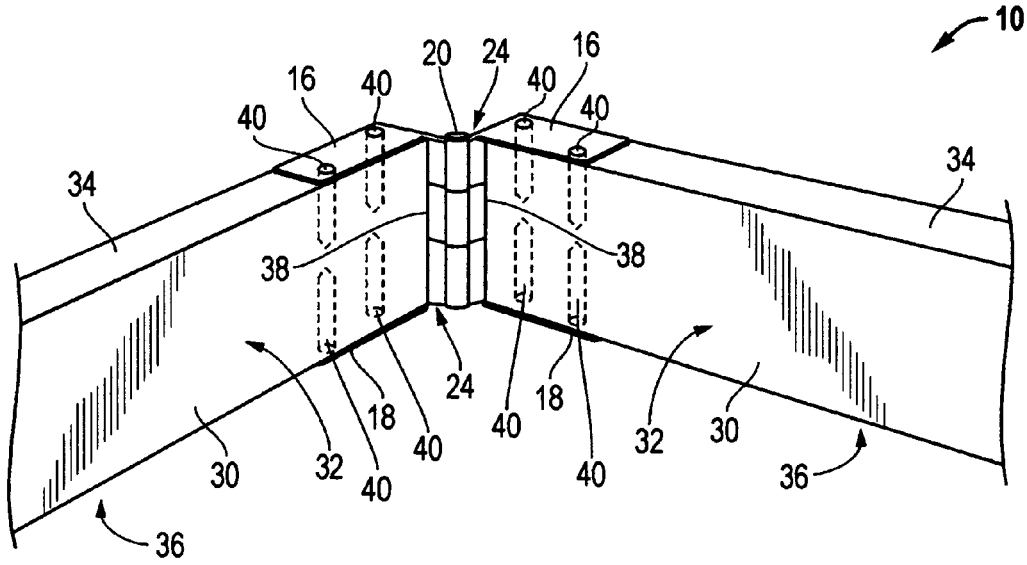
FIG. 4 is a perspective view of the hinge apparatus of the present invention shown vertically attached gate stringers and shown in the open position.

Referring now to FIG. 4, a preferred embodiment of the hinge apparatus 10 is shown attached to stringers 30. Stringers 30 have a face 32, a top edge 34, a bottom edge 36 and an end 38. Hinge apparatus 10 is attached to stringers 30 by placing upper flange section 16 over the top edge 34 and lower flange section 18 over the bottom edge 36 and pressing first and second hinge connection sections 12 and 14, including preferably connecting face section 13, against the ends 38. At that point, screws 40 are screwed vertically into the top edge 34 and the bottom edge 36 of stringers 30. The vertical location of the screws 40 is shown in dotted lines in FIG. 4. Once the hinge apparatus 10 is attached, facing fence boards (not shown) are attached to the face 32 of stringers 30 to complete a typical gate system as is known in the art. It should be obvious to those of ordinary skill, that should a user wish to have a gate that swings in the opposite direction, all the user has to do is rotate the hinge apparatus 10 180-degrees from the position shown in FIG. 4, for example, and then attach the hinge apparatus 10 to the stringers 30 as just discussed.

For the purposes of a complete description of the hinge apparatus 10 it should be mentioned again that the prior art devices connect the hinges to stringers 30 "horizontally". By that it is meant that the screws 40 used to attach prior art hinges are screwed into the end 38 or face 32 of stringers 30. Thus, all the weight of the moving portion, the gate, is supported on the screws 40 and all such horizontally attached hinges succumb, over time, to gravity. By way of contrast, however, Applicant's hinge apparatus 10, as discussed and illustrated, attaches vertically to stringers 30. Upper and lower flanges 16 and 18 capture the top edge 34 and bottom edge 36 in between them and will not succumb to gravity in any measurable amount. The hinge apparatus 10, that is, supports the stringer 30 from underneath and above and thereby utilizes the inherent strength of the stringer in a vertical grip. Further, Applicant's hinge apparatus 10 allows, again, for a gate to swing "out" or "in" simply by reversing the hinge apparatus 10 as described above.

It should be apparent that hinge apparatus 10 may be made out of or used with any materials and with any size stringers 30, for example, and not simply the normal "two by four" as is commonly used in gate construction. Metal drive gates are a perfect example of another gate application for which Applicant's hinge apparatus is well suited.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A hinge apparatus comprising:

a. a first hinge connection face with a length and a width and with a first offset extension with a first side and a second side and wherein said first side of said firs/offset extension is connected with and extends from said first hinge connection face along said length;

b. a second hinge connection face with a length and a width and with a second offset extension with a first side and a second side and wherein said first side of said second offset extension is connected with and extends from said second hinge connection face along said length;

c. a first upper flange connected with said width of said first hinge connection face transverse to said length of said first hinge connection face and a second upper flange connected with said width of said second connection face transverse to said length of said second hinge connection face;

d. a first lower flange connected with said width of said first hinge connection face transverse to said length of said first hinge connection face and spaced apart from said first upper flange by said length of said first hinge connection face and a second lower flange connected with said width of said second connection face transverse to said length of said second hinge connection face and spaced apart from said second upper flange by said length of said second hinge connection face;

e. a first hinge pin receiver connected with said second side of said first offset extension and being parallel to said length of said first hinge connection face and a second hinge pin receiver connected with said second side of said second offset extension and being parallel to said second hinge connection face; and f. a hinge pin connected with said first hinge pin receiver and said second hinge pin receiver.

2. The apparatus of claim 1 wherein said first upper and lower flange sections and said second upper and lower flange sections are connected at approximately right angles to said first hinge connection face and said second hinge connection face respectively.

3. The apparatus of claim 1 wherein said first upper and lower flange sections and said second upper and lower flange sections include attachment holes.

4. The apparatus of claim 1 wherein said first sides of said first and second offset extensions extend from said first hinge connection face and said second hinge connection face from approximately ⅝ inch to approximately 1⅛ inch.

* * * * *

UNITED STATES PATENT AND TRADEMARK OFFICE

CERTIFICATE OF CORRECTION

PATENT NO. : 7,665,187 B1
APPLICATION NO. : 11/485794
DATED : February 23, 2010
INVENTOR(S) : James E. Elowsky It is certified that error appears in the above-identified patent and that said Letters Patent is hereby corrected as shown below:

Col. 5, Line 9, in Claim 1a: "firs/" should read "first".

Signed and Sealed this

Thirty-first Day of August, 2010

David J. Kappos

David J. Kappos
*Director of the United States Patent and Trademark Office*